US010240844B1

(12) United States Patent
Metzger et al.

(10) Patent No.: US 10,240,844 B1
(45) Date of Patent: Mar. 26, 2019

(54) ICE BAGGER FOR ICE MERCHANDISER

(71) Applicant: Premier Ice Manufacturing, Inc., Glendale, AZ (US)

(72) Inventors: Mark Metzger, Glendale, AZ (US); Brandon Metzger, Glendale, AZ (US)

(73) Assignee: Premier Ice Manufacturing, Inc., Glendale, AZ (US)

( * ) Notice: Subject to any disclaimer, the term of this patent is extended or adjusted under 35 U.S.C. 154(b) by 87 days.

(21) Appl. No.: 15/434,029

(22) Filed: Feb. 15, 2017

(51) Int. Cl.
*B65B 5/06* (2006.01)
*F25C 5/20* (2018.01)

(52) U.S. Cl.
CPC ..... *F25C 5/24* (2018.01); *B65B 5/061* (2013.01)

(58) Field of Classification Search
CPC ..... F25C 5/24; B65B 5/061
See application file for complete search history.

(56) References Cited

U.S. PATENT DOCUMENTS 6,112,539 A * 9/2000 Colberg ..... G07F 11/68 62/331
2011/0185685 A1* 8/2011 Metzger ..... B65B 1/06 53/473
2018/0087319 A1* 3/2018 McPherson ..... E06B 9/42

* cited by examiner

*Primary Examiner* — Ana M Vazquez
(74) *Attorney, Agent, or Firm* — Thomas W. Galvani, P.C.; Thomas W. Galvani

(57) ABSTRACT

A bagger for an ice vending machine provides improved design, operation, and maintenance characteristics. An ice vending machine includes a merchandiser having a door providing access into an interior, an ice maker with a chute, and an ice bagger mounted to the merchandiser in communication with the ice maker. The ice bagger includes a frame having opposed, unitary, first and second frame elements, a spool of bags pivoted to a front of the frame on a swingarm, a cutting element mounted to the frame for reciprocal movement, and a tensioning assembly carried on the frame to provide tension to bags unrolled from the spool.

20 Claims, 11 Drawing Sheets

ICE BAGGER FOR ICE MERCHANDISER

FIELD OF THE INVENTION

The present invention relates generally to vending machines, and more particularly to ice producing, bagging, and vending machines.

BACKGROUND OF THE INVENTION

Bagged ice at grocery stores, gas stations, and other facilities provides an important convenience to consumers who need a large quantity of ice at once. To meet such demands, many retailers receive regular deliveries of ice from an ice manufacturer. However, for some retailers, deliveries are too infrequent or too expensive given the size of the deliveries needed, the consumer demand for ice, or the remoteness or location of the retailer. Those retailers that need to maintain a large inventory of ice often have an industrial ice machine that makes ice on site, eliminating the need for deliveries of ice. This is a common practice for large grocery stores and warehouse stores, for example.

Ice vending machines—ice merchandisers that create, bag, and vend ice—provide considerable cost savings to the retailer. The retailer does not need to pay the ice manufacturer or vendor, who must cover the costs of ice factory worker salaries, driver salaries, fuel costs, delivery truck maintenance and insurance, and other costs. Further, the retailer avoids exposure to ice shortages due to infrequent deliveries of ice.

Other retailers may not be large, but are remote. Convenience stores and small grocers in rural areas may infrequently receive ice deliveries, and so are subject to ice shortages, or, conversely, an oversupply of ice just after a delivery. For such retailers, ice deliveries are an imperfect solution.

Ice vending machines are thus helpful to many retailers. However, conventional ice vending machines have a number of drawbacks. Most are quite expensive because they are very complicated. Corresponding—or perhaps owing—to the complexity, most are structurally intricate and frequently need repair. Repair can take a long time, because the vending machines are designed poorly, with inlaid and dependent parts that require a great deal of labor to remove, service, and replace. To replace one part of the vending machine, for example, several overlying parts may need to be removed to gain access to the one part. Further, if those overlying parts are moving parts, their proper replacement and positioning is critical. Thus, a repair person must be a skilled technician and will generally need a great deal of time to fix a broken ice vending machine. For the retailer, this translates into increased hourly labor costs, a likely increased duration of labor, and a loss of sales during the downtime.

Most ice vending machines include an ice merchandiser, a bagger, and one or several ice makers. Merchandisers are refrigerated cabinets in which ice is stored. These often are not a major source of repairs. Nor are the ice makers, which are conventional technology for creating different types of ice. Rather, most service calls on an ice vending machine are related to the bagger, the part of the vending machine which fills and seals the bags of ice. An improved bagger for ice vending machines is needed.

SUMMARY OF THE INVENTION

An ice bagging machine for an ice vending machine provides improved design, operation, and maintenance characteristics. An ice vending machine includes a merchandiser having a door providing access into an interior, an ice maker with a chute, and an ice bagger mounted to the merchandiser in communication with the ice maker. The ice bagging machine includes a frame having opposed, unitary, first and second frame elements, a spool of bags pivoted to a front of the frame on a swingarm, a cutting element mounted to the frame for reciprocal movement, and a tensioning assembly carried on the frame to provide tension to bags unrolled from the spool. Bags are automatically fed, filled, cut, and sealed by the ice bagging machine and are the ready to be deposited within the merchandiser.

In slightly more detail, an ice bagging machine for use on an ice vending machine includes a frame having opposed, unitary, first and second frame elements, a spool of bags pivoted to a front of the frame on a swingarm, a heating element carried near a rear of the frame, a cutting element, distal to the heating element, mounted to the frame for reciprocal movement toward and away from the heating element, and a tensioning assembly carried on the frame to provide tension to bags unrolled from the spool. The tensioning assembly rises obliquely from the front of the frame toward the rear of the frame, defining a drop space under the tensioning assembly in which the heating element is disposed. The tensioning assembly includes a set of lower rollers, a set of upper rollers moveable between a lowered position in meshing engagement with the set of lower rollers, and a raised position away from the lower rollers, and a set of fixed rollers above and behind the sets of lower and upper rollers. The set of fixed rollers is carried in slots formed downwardly into the opposed first and second frame elements, and is restrained by two caps covering those slots. The swingarm is pivoted to the set of upper rollers, such that pivoting the spool of bags from a retracted position to an extended position imparts movement of the set of upper rollers from the lowered position to the raised position. The cutting element is mounted on a first slide on the first frame element and a second slide on the second frame element, and is driven by drive means disposed centrally to the first and second frame elements. In some embodiments, a guide is below the tensioning assembly and includes a plurality of laterally-spaced apart, downwardly-turned fingers. The cutting element moves between an advanced position and a retracted position; in the advanced position, the cutting element is against the heating element, and in the retracted position, the cutting element is behind the guide. The cutting element includes a cutting edge formed with a recess, and that recess is configured to be disposed below a chute of an ice maker when the ice bagging machine is applied to the ice vending machine.

The above provides the reader with a very brief summary of the detailed description presented below, and is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
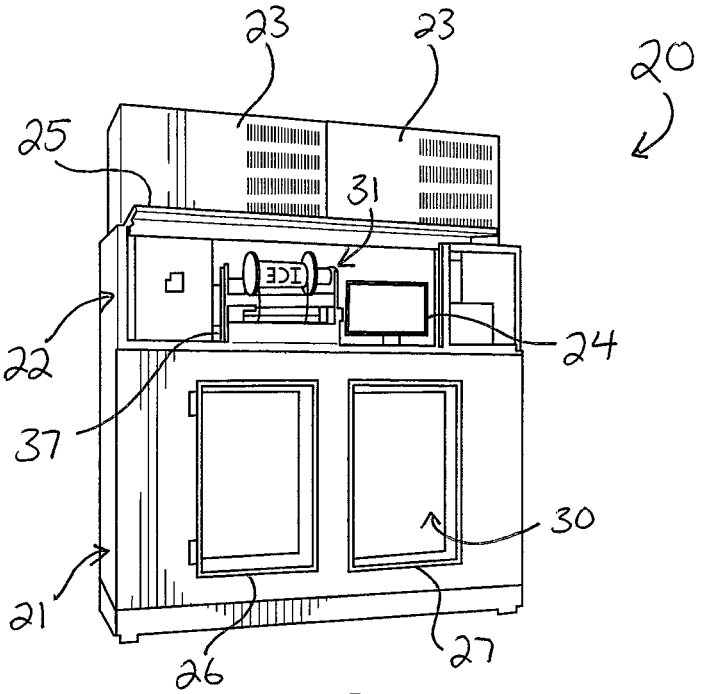
FIG. 1 is a front perspective view of an ice merchandiser equipped with an ice bagger.

Reference now is made to the drawings, in which the same reference characters are used throughout the different figures to designate the same elements. FIG. 1 illustrates an ice vending machine 20 constructed and arranged according to the principle of the invention. The ice vending machine 20 includes a merchandiser 21, an enclosure 22 mounted atop the merchandiser 21, and two ice makers 23 mounted atop the enclosure 22. A computer 24 with a display monitor is coupled in data communication to the merchandiser 21, the enclosure 22, and the ice makers 23 to gather information from those components and to control the production, bagging, and distribution of bags of ice in the ice vending machine 20. In FIG. 1, the enclosure 22 is shown with a front cover 25 lifted to expose the components within the enclosure 22.

The merchandiser 21 is an insulated, refrigerated, temperature-controlled housing having two doors 26 and 27 providing access into a refrigerated interior 30 of the merchandiser 21 in which bags of ice are made available for a customer to choose. The doors 26 and 27 have windows allowing customers to view the interior 30 of the merchandiser 21 before reaching into the refrigerated interior 30. The doors 26 and 27 each include a sensor for detecting when one or both of the doors 26 and 27 is opened. One having reasonable skill in the art will readily appreciate that the merchandiser 21 may be of several sizes and arrangements as are common and well-known, such as four-foot or six-foot wide single-door merchandisers, eight-foot wide double-door merchandisers, twelve-foot wide triple-door merchandisers, and similar arrangements. The merchandiser 21 shown in FIG. 1 is exemplary of an eight-foot wide double-door merchandiser.

The enclosure 22 is set above the merchandiser 21 and covers an ice bagging machine (or "ice bagger" 31) for holding and dispensing bags 32 and for opening, filling, sealing, and depositing those bags 32 within the interior 30 of the merchandiser 21. The ice bagger 31 includes a bag feed assembly 33 (shown in FIG. 12) for storing and dispensing the bags 32 to be filled with ice. The ice bagger 31, and all structural elements carried by the ice bagger 31, are mounted on a frame 37. The frame 37 includes two opposed frame elements 38 and 39 (shown in FIGS. 3A and 7) extending entirely along opposed sides of the ice bagger 31. The frame 37 is mounted to the enclosure 22, such as with bolts, screws, or like fasteners, and all pieces of the ice bagger 31 are mounted to the frame 37. This two-piece construction of the frame greatly improves efficiency of manufacturability, but also produces real maintenance and repair benefits, saving time when parts of the ice bagger 31 need to be checked or replaced.

Figure 12:
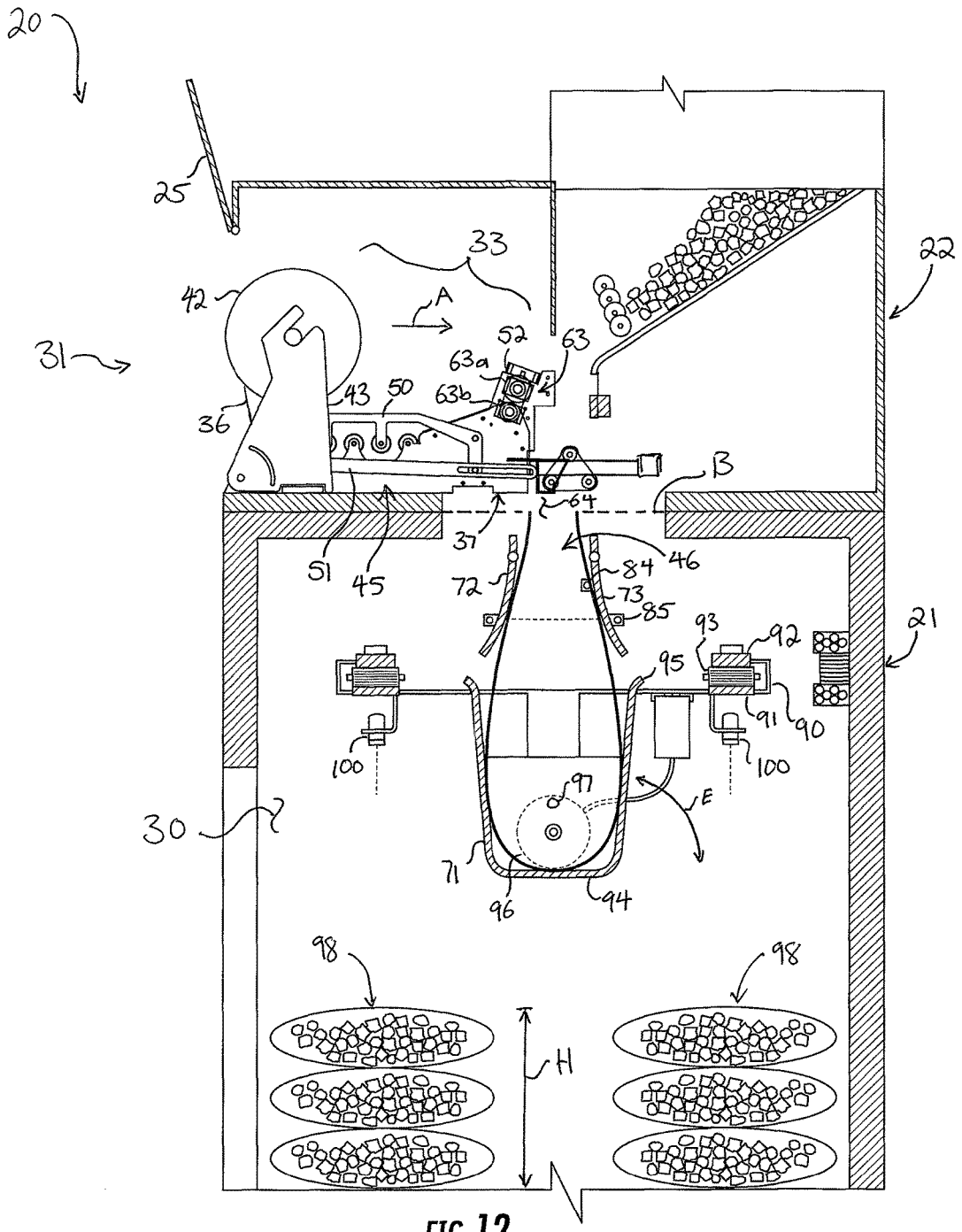
FIG. 12 is a stylized, section view bisecting the ice merchandiser of FIG. 1 equipped with the ice bagger.

Turning briefly to FIG. 12, which illustrates the ice vending machine 20 in a generalized section view bisecting the ice vending machine 20 from front to back, a sheet 36 of bags 32 is shown moving through the ice bagger 31 along the direction indicated by the arrowed line A, which represents downstream movement through the ice vending machine 20. The bag feed assembly 33 is shown disposed above a broken line B, representing a boundary between the enclosure 22, above the broken line B, and the merchandiser 21, below the broken line B.

Figure 2:
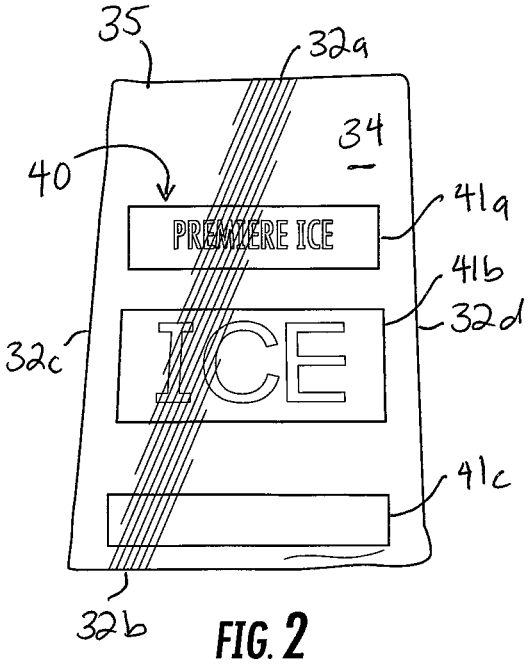
FIG. 2 is a front perspective view bag for filling and vending within the ice merchandiser of FIG. 1.

An exemplary bag 32 is shown in FIG. 2 with the understanding that the description of the exemplary bag 32 of FIG. 2 applies equally to all the bags 32 used in the ice vending machine 20, even though some bags 32 may have different sizes and proportions. The bags 32 stored in the ice bagger 31 are identical and are stored in a long continuous sheet 36 of bags 32 marked with a perforated edge 35 between each bag 32. The bag 32 has a top 32*a*, bottom 32*b*, and opposed sides 32*c* and 32*d*. The bag 32 has a major or front face 34 which is flat and extends between the top 32*a* and bottom 32*b* and between the sides 32*c* and 32*d*. The bag 32 is constructed of two bonded sheets of transparent plastic or other strong, flexible material, and carries a pattern 40 of horizontal, opaque bands 41 extending substantially across the front face 34 of the bag 32 between the sides 32*c* and 32*d*. As the term is used here, "horizontal" means extending between the sides 32*c* and 32*d*, while "vertical" or "longitudinal" will mean extending between the top 32*a* and bottom 32*b*.

The pattern 40 of bands 41 are configured to be read by an optical sensor during relative translational movement of the bag 32 past the optical sensor in the ice bagger 31 from between the bottom 32*d* and top 32*c* of the bag 32. The patterns 40 are non-unique, in that every bag 32 carries the same pattern 40 of bands 41 arranged in the same manner and having the same size characteristics. Therefore, each pattern 40 identifies one bag 32, though not uniquely so. The bands 41 are spaced apart from each other between the top 32*a* and bottom 32*b* of the bag 32. A first minor band 41*a* is located proximate to the top 32*a*, a major band 41*b* is located at a generally intermediate position between the top 32*a* and bottom 32*b*, and a second minor band 41*c* is located between the major band 41*b* and the bottom 32*b*. The bands 41*a*, 41*b*, and 41*c* each have different heights between the top 32*a* and bottom 32*b* of the bag 32 and are vertically separated from each other by different distances.

The bag feed assembly 33 is shown in detail in FIGS. 3A, 3B, 4, 5A, and 5B. The bag feed assembly 33 includes a spool 42 mounted to the enclosure 22 for pivotal movement along the double-arrowed arcuate line C in FIGS. 3A and 3B between a retracted or working condition (shown in FIG. 3A), in which the sheet 36 of bags 32 on the spool 42 are wound, ready, and available during operation of the ice vending machine 20, and an extended or refilling condition (shown in FIG. 3B), in which the spool 42 is pivoted out of the enclosure 22 to the front of the ice vending machine 20 so as to be available to be replaced with a new spool 42 of bags 32.

The spool 42 pivots on opposed, identical swingarms 43 and 44 about an axis parallel to the front of the enclosure 22. In the extended or refilling condition, the spool is extended out, cantilevered conveniently in front of the enclosure 22 where a store attendant can service the ice vending machine 20 without having to move behind the ice vending machine 20, reach deep into the ice vending machine 20, or perform other difficult and strenuous maneuvers to replace the spool 42.

The swingarms 43 and 44 are identical and mounted on opposed sides of the bag feed assembly 33. The swingarm 43 has a pivot end 43*a* and an opposed distal end 43*b* which rotates about the pivot end 43*a*. The pivot end 43*a* is mounted on a pin secured in the frame 37 so that the pivot end 43*a* pivots about the pin. The distal end 43*b* of the swingarm 43 is formed with a cradle 43*c* to allow quick application and removal of the spool 42 from the swingarm 43. The cradle 43*c* has an enlarged lower lip 43*d* defining an opening 43*e* in the distal end 43*b* which is structured to prevent the spool 42 from coming loose from the cradle 43*c* when the swingarm 43 is lowered and the spool 42 is in the extended condition. Likewise, the swingarm 44 has a pivot end 44*a* which is mounted to the enclosure 22 for rotation, and an opposed distal end which rotates about the pivot end 44*a*. The pivot end 44*a* is mounted on a pin secured in the frame 37 so that the pivot end 44*a* picots about the pin. The distal end is formed with a cradle with an enlarged lower lip and an opening to allow quick application and removal of the spool 42 from the swingarm 44. The cradle prevents the spool 42 from coming loose from the swingarm 44 when the swingarm 44 is lowered and the spool 42 is in the extended position.

Referring briefly back to the schematic shown in FIG. 12, the spool 42 carries the sheet 36 of bags 32 for provision from the bag feed assembly 33. The sheet 36 of bags 32 extends from the spool 42, at the front of the enclosure 22, toward the middle of the enclosure through a tensioning assembly 45. The tensioning assembly 45 includes sets of upper and lower rollers (hereinafter identified as upper and lower assemblies 50 and 51, respectively) and a driven upper roller 52. The tensioning assembly 45 provides tension to the bags 32 unrolled from the spool 42 and directs the sheet 36 of bags 32 to a bag filling location 46 for filling with ice.

The upper and lower roller assemblies 50 and 51, which are a part of the bag feed assembly 33, provide and maintain tension to the sheet 36 of bags 32 as the sheet 36 is moved through the ice vending machine 20. With reference to FIGS. 5A, 5B, 6A and 6*b*, the lower roller assembly 51 includes two spaced-apart rollers 53 and 54, each of which is an elongate cylindrical member or mandrel mounted for rotation. The rollers 53 and 54 are mounted directly to the frame 37 on pins.

Both of the rollers 53 and 54 are aligned parallel to the front of the enclosure 22 and to the spool 42, so that the sheet 36 of bags 32 rolls from the spool 42 to the lower roller assembly 51 without twisting or binding. The lower roller assembly 51 is fixed to and within the frame 37, and the rollers 53 and 54 are spaced above the merchandiser 21 at a level and common height. A small guide roller 55 (visible in FIG. 6B) is fixed to the frame 37 as well and is disposed in front of and below the roller 53. The guide roller 55 guides and re-directs the sheet 36 of bags 32 from the spool 42 to over the first roller 53 in the lower roller assembly 51.

The upper roller assembly 50 pivots with respect to the lower roller assembly 51. The upper roller assembly 50 includes a single elongate, cylindrical roller 60 mounted for rotation on opposed arms 61 and 62. The arms 61 and 62 are mounted directly to the frame 37 for pivotal movement along the double-arrowed arcuate line D shown in FIG. 5B to allow the upper roller assembly 50 to pivot between a lowered position (shown in FIGS. 5A and 6A), in which the upper roller assembly 50 is ready for operation, and a raised position (shown in FIGS. 5B and 6B), in which the upper roller assembly 50 is away from the lower roller assembly 51.

In the lowered position of the upper roller assembly 50, the roller 60 is disposed between and below the rollers 53 and 54 of the lower roller assembly 51. The roller 60 is enmeshed with the rollers 53 and 54, with the roller 60 between and just below the rollers 53 and 54. The sheet 36 of bags 32 is wound through the upper and lower roller assemblies 50 and 51, with the sheet 36 extending over the roller 53, under the roller 60, and over the roller 54. In the raised position of the upper roller assembly 50, the roller 60 is separated from and above the rollers 53 and 54, and the sheet 36 of the bags 32 lies across the rollers 53 and 54. When the upper roller assembly 50 moves from the raised position to the lowered position, as would happen when the bag feed assembly 33 is being readied for operation, the roller 60 catches and depresses the sheet 36 of bags 32 between the rollers 53 and 54.

Referring back to FIG. 12, downstream from the upper and lower roller assemblies 50 and 51 are drive rollers 63 disposed above a vertical drop space or throat 64, each of which are a part of both the ice bagger 31 and the bag feed assembly 33. The drive rollers 63 are downstream from the upper and lower roller assemblies 50 and 51 and include a top roller 63*a* and a bottom roller 63*b*. The top roller 63*a* is a tension roller, and the bottom roller 63*b* is operatively coupled to and driven by a motor to advance the sheet 36 of bags 32 downstream along line A through the bag feed assembly 33. The bottom roller 63*b* carries annular gaskets or O-rings to provide friction or adhesion between the bottom roller 63*b* and the sheet 36 of bags 32 to advance the sheet 36 of bags 32 through the tensioning assembly 45 in response to rotation of the bottom roller 63*b*.

As shown in FIG. 12, the rollers 63 are disposed higher than the upper and lower roller assemblies 50 and 51. Accordingly, the tensioning assembly 45 rises, or is oriented, obliquely from front to back: the tensioning assembly 45 is at a lower height proximate to the front of the frame 37, and is at a greater height at the driven upper roller 52 at the rear of the frame 37. The rollers 63 are tiered or stepped-up rearwardly: the roller 63*a* is above and just behind the roller 63*b*, providing the rollers 63 with an angled orientation. Because the rollers 63 are elevated with respect to the upper and lower roller assemblies 50 and 51, the throat 64 defines a drop space: an empty, bound, and open vertical volume under the tensioning assembly 45. The sheet 36 of bags 32 falls from the rollers 63 vertically into the throat 64, where bags 32 are blown open, filled, sealed, and separated from the sheet 36. The rearward tiered or stepped-up arrangement of the rollers 63 urges the sheet 36 of bags 32 to fall faster and improves the speed and reliability with which the sheet 36 of bags 32 can be fed through and out of the bag feed assembly 33; because the sheet clears the roller 63*b* first, the sheet 36 drapes over and drops behind the roller 63*b*, ready to fall into the throat 64.

As shown in FIGS. 8, 9, 10, 11A, and 11B, downstream from and below the drive roller 63 is a cutting element 70, which forms part of the ice bagger 31. The cutting element 70 is mounted to move reciprocally through the throat 64, so that when a bag 32 is hanging in the throat 64 between the cutting element 70, the cutting element 70 moves against the bag 32 to cut the top 32*a* of the bag 32 after the bag 32 has been filled with ice. The cutting element 70 has a leading scalloped or serrated cutting edge 74 directed toward the throat 64. The cutting edge 74 extends entirely across the cutting element 70 and includes a central recess 75. The recess 75 is sharpened and is thus part of the cutting edge 74, but is recessed or set back from the leading portion of the cutting edge 74, to accommodate an ice chute, as will be explained.

The cutting element 70 is mounted on a piston 76, pneumatic actuator, solenoid, or like reciprocating device defining drive means. In the embodiment shown in the drawings, this drive means is a piston 76, but in other embodiments, the drive means is some other device which imparts reciprocal movement to the cutting element 70, such as an eccentric or a camming device. The rod of the piston 76 is seen best in FIG. 9. The rod is secured onto the cutting element 70 centrally on the cutting element 70, just behind the recess 75. The cutting element 70 itself has two slides 78 at opposed sides of the cutting element 70. The slides 78 are carried on rails 77. The slides 78 include a triangular plate carrying two upper wheels and one lower wheel; the upper wheels ride above the rail 77 and the lower wheel rides below the rail 77. The rails 77 are mounted directly to the frame 37 and are oriented in a horizontal arrangement. The piston 76 actuates in response to an electronic instruction and pushes the cutting element 70 forward and pulls it back from a central location. This centrally-located drive means provides a centrally-directed push that prevents binding of the cutting element 70 on the rails 77; movement of the opposed slides 78 on the opposed rails 77 in response to the push from the piston 76 allows the cutting element 70 to move smoothly.

Figure 10:
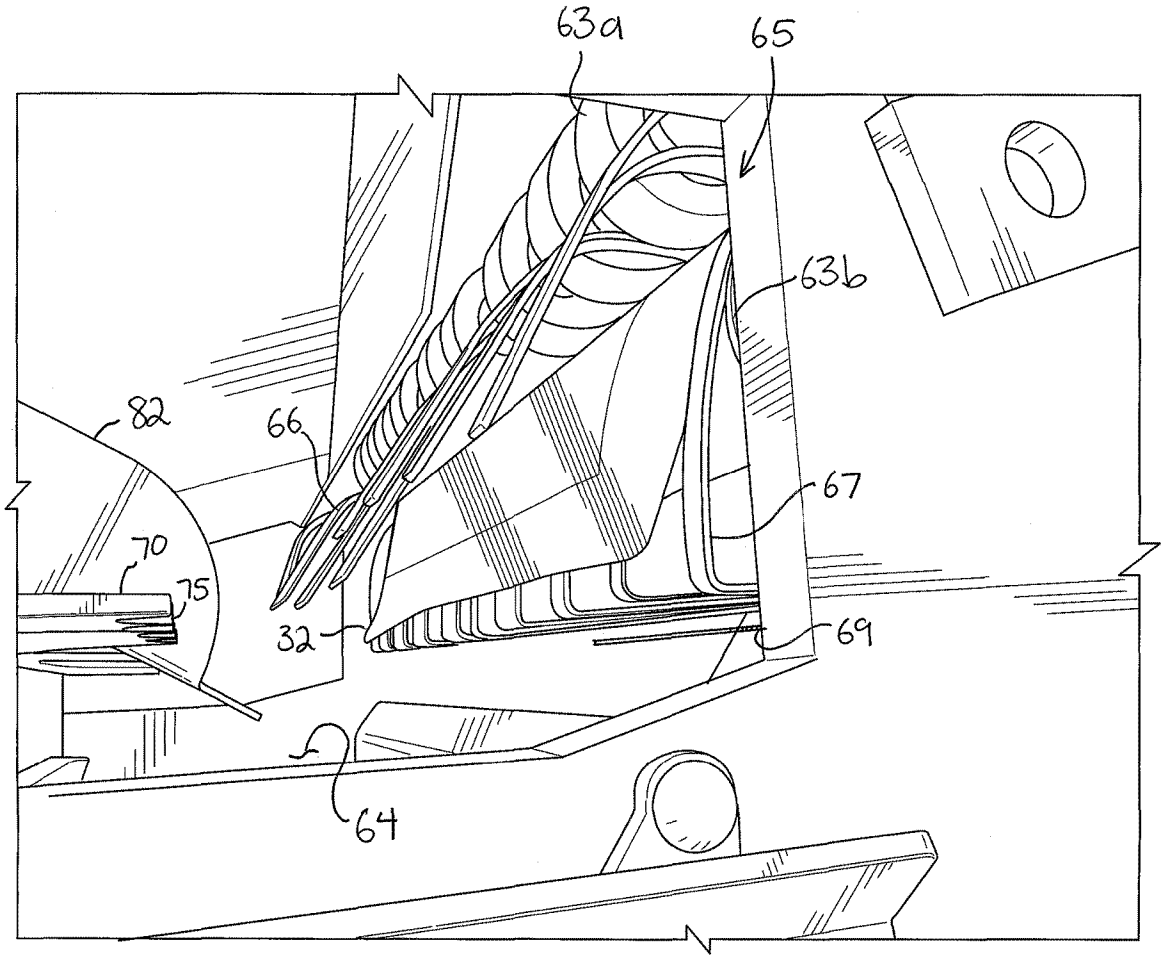
Figure 11A:
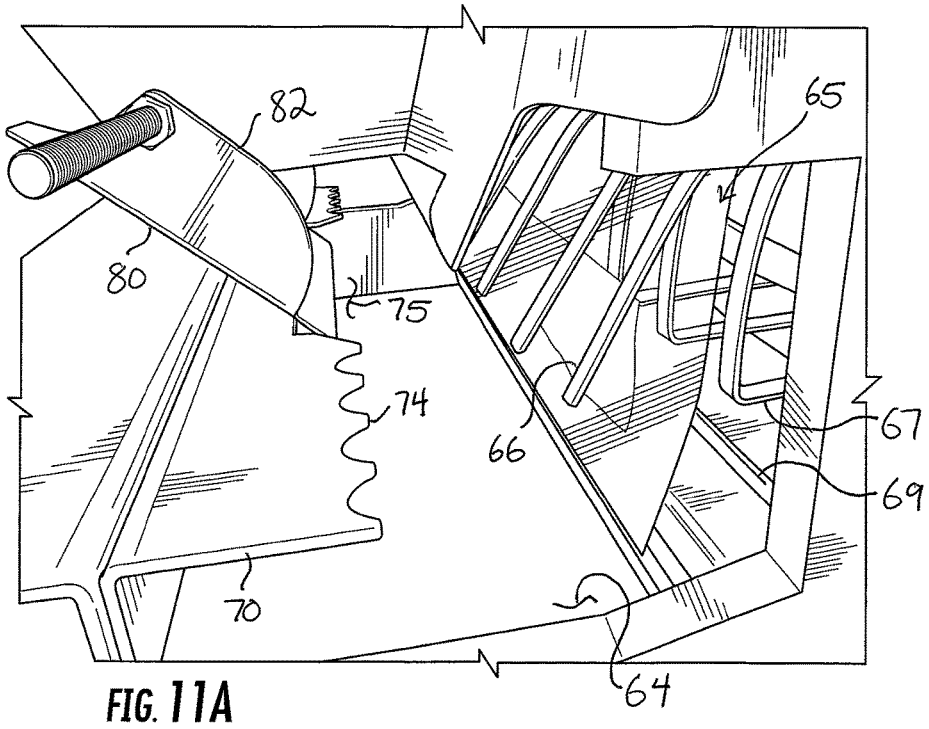
FIGS. 11A and 11B are rear perspective views of the guide and the cutting element.
Figure 11B:
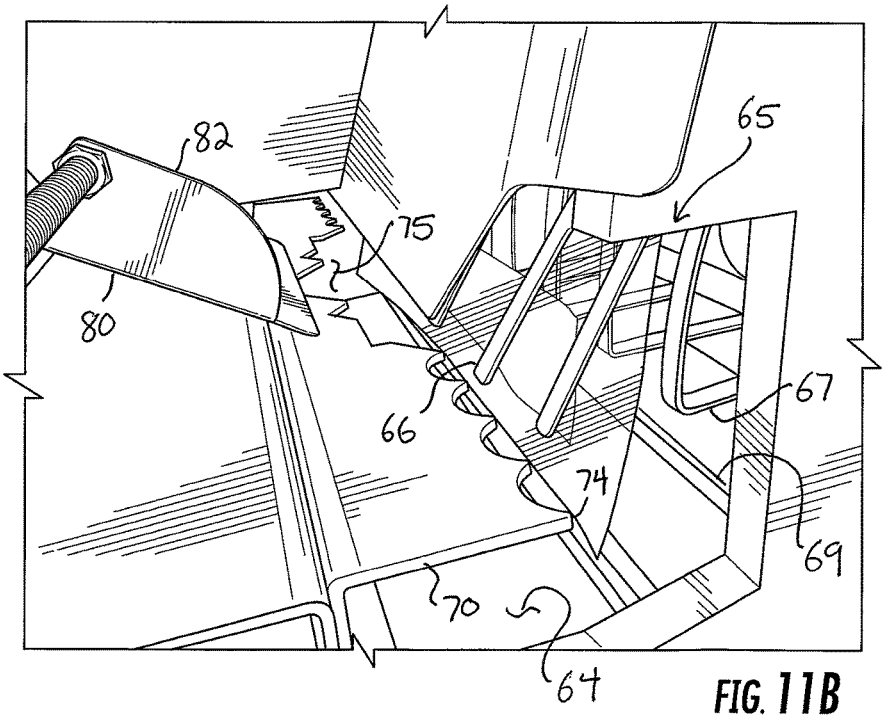

Referring now to FIG. 10, the throat 64 is downstream from the rollers 63, disposed just behind and below the rollers 63*a* and 63*b*. The throat 64 is bound front-to-back at its top by a guide 65. The guide 65 includes two sets of fingers 66 and 67 below the tensioning assembly 45. The guide 65 is positioned behind and flanks an exit from the two opposed rollers 63*a* and 63*b*. The fingers 66 are disposed behind the fingers 67. The fingers 67 are thin, spaced-apart elements which extend downwardly from proximate to the rollers 63*b* and then bend forwardly. The fingers 66 are thin, spaced-apart elements which extend rearwardly from proximate to the rollers 63*a* and then are directed downwardly, terminating in free ends. The corresponding structure of the fingers 66 and 67 directs the sheet 36 of bags 32 rearwardly and then downwardly into the throat 64. The fingers 66 and 67 are resilient and resist deflection, so as to hold a bag 32 hanging in the throat 64 upright when the bag 32 is both empty and filled. The cutting element 70 reciprocates just below the fingers 66 and 67, so that when the cutting element 70 advances forward, it pulls the bag 32 against the fingers 67 to improve cutting of the bag.

Referring to FIG. 12, below the throat 64 are two opposed flaps 72 and 73 depending into the top of the merchandiser 21 through a hole 74 formed between the enclosure and the merchandiser 21. The flaps 72 and 73 are spaced apart, bounding the bag 32 when the bag 32 is applied to the throat 64. The flaps 72 and 73 hang generally above a basket 71 and resist movement away from this hanging position, so as to aid in holding the bag 32 upright when the bag 32 is empty and then hold the bag 32 upright in the basket 71 when the bag 32 is filled with ice.

The basket 71 and flaps 72 and 73 are configured to cooperatively hold the bag 32, and when the bag 32 is seated in the basket 71, the top 32*a* of the bag 32 is disposed just below the fingers 66 and 67. A chute 80 is located just above and behind the fingers 76 and 77, just above the top 32*a* of the bag 32, and just above the cutting element 70. The chute 80 directs and funnels ice produced in the ice makers 23 into the bag 32 held in the basket 71. A fan assembly, including a blower and a flexible hose 81, is mounted next to the chute 80. When operating, the fan assembly blows air through the hose 81, down the chute 80 and into the bag 32 to open the bag 32. The chute 80 direct the air through toward the top 32*a* of the bag 32. The chute 80 terminates in a contoured plate 82 pivoted to the chute 80 for pivotal movement. The plate 82 pivots in response to the reciprocal movement of the cutting element 70, between a blocked condition, tilted up and blocking the chute 80 when the cutting element 70 is advanced forward, and an open condition, tilted down and extending through the recess 75 when the cutting element 70 is advanced rearward. Thus, as the cutting element 70 moves forward and backward, it causes the plate 82 to pivot up and down, thereby closing and opening the chute 81 to prevent or allow the movement of ice out of the chute 81. The plate 82 fits into the recess 75 when the cutting element 70 is retracted.

Figure 7:
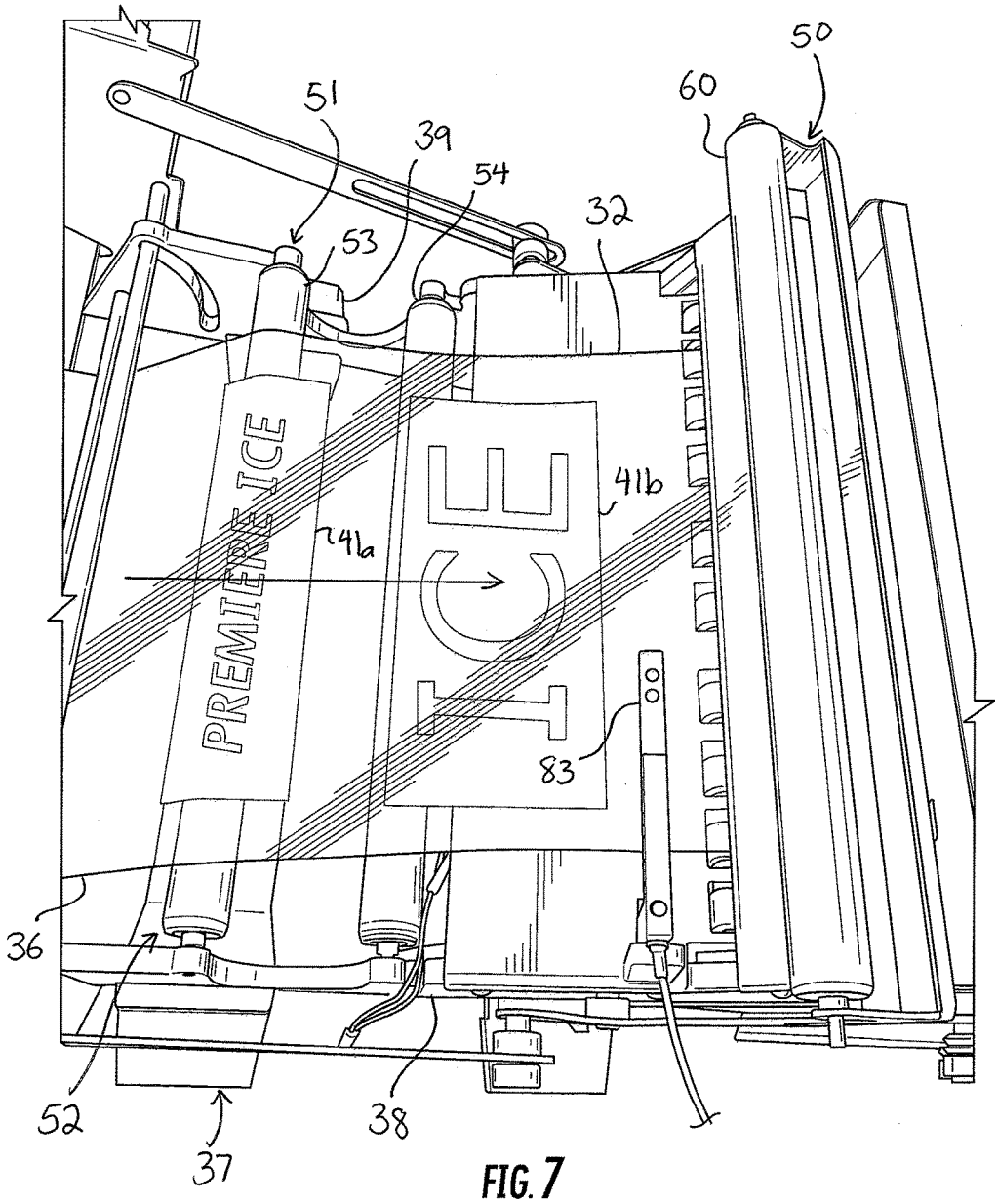
FIG. 7 is a top perspective view of the bag of FIG. 2 moving through the ice bagger of FIG. 1.
Figure 8:
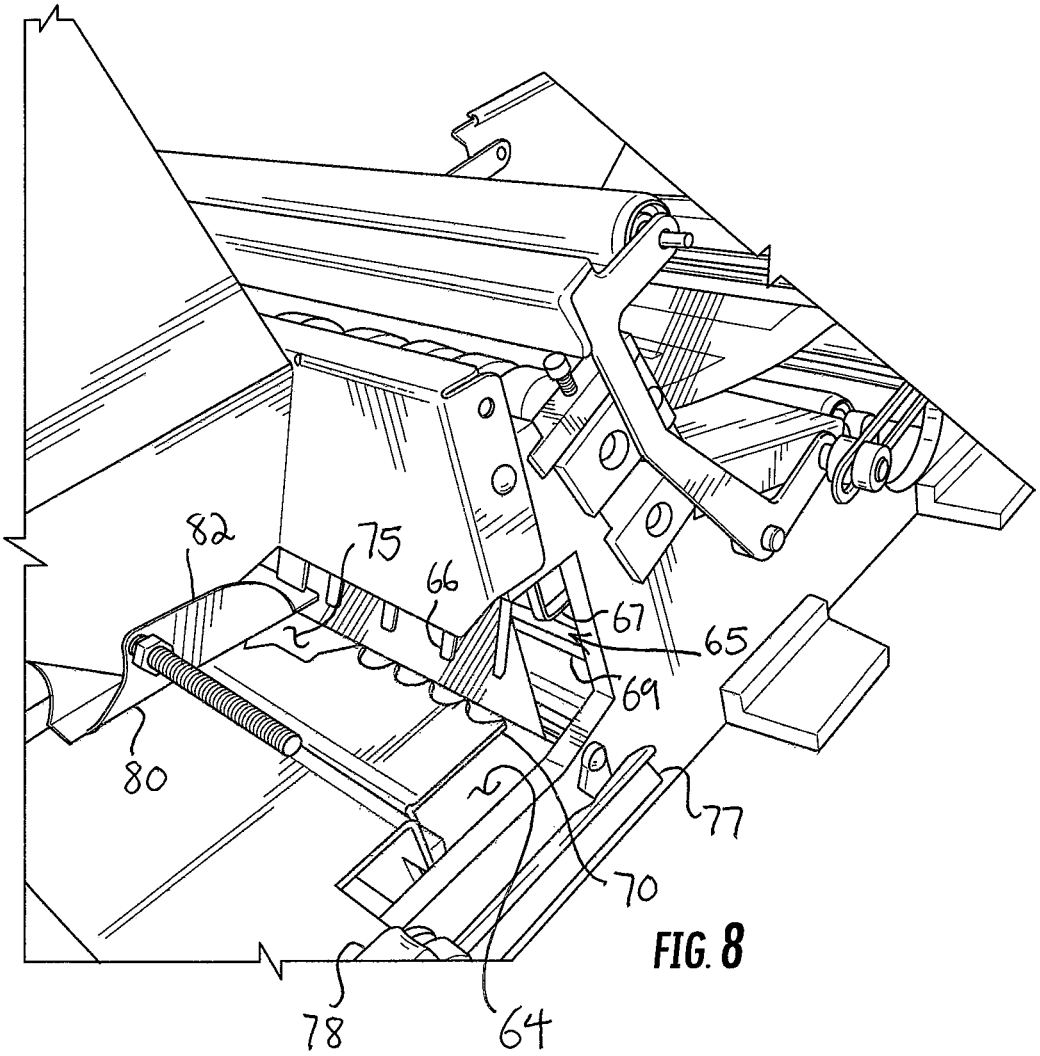
FIGS. 8-10 are rear perspective views of the tensioning assembly, showing a throat formed underneath the tensioning assembly, and a guide and cutting element.
Figure 9:
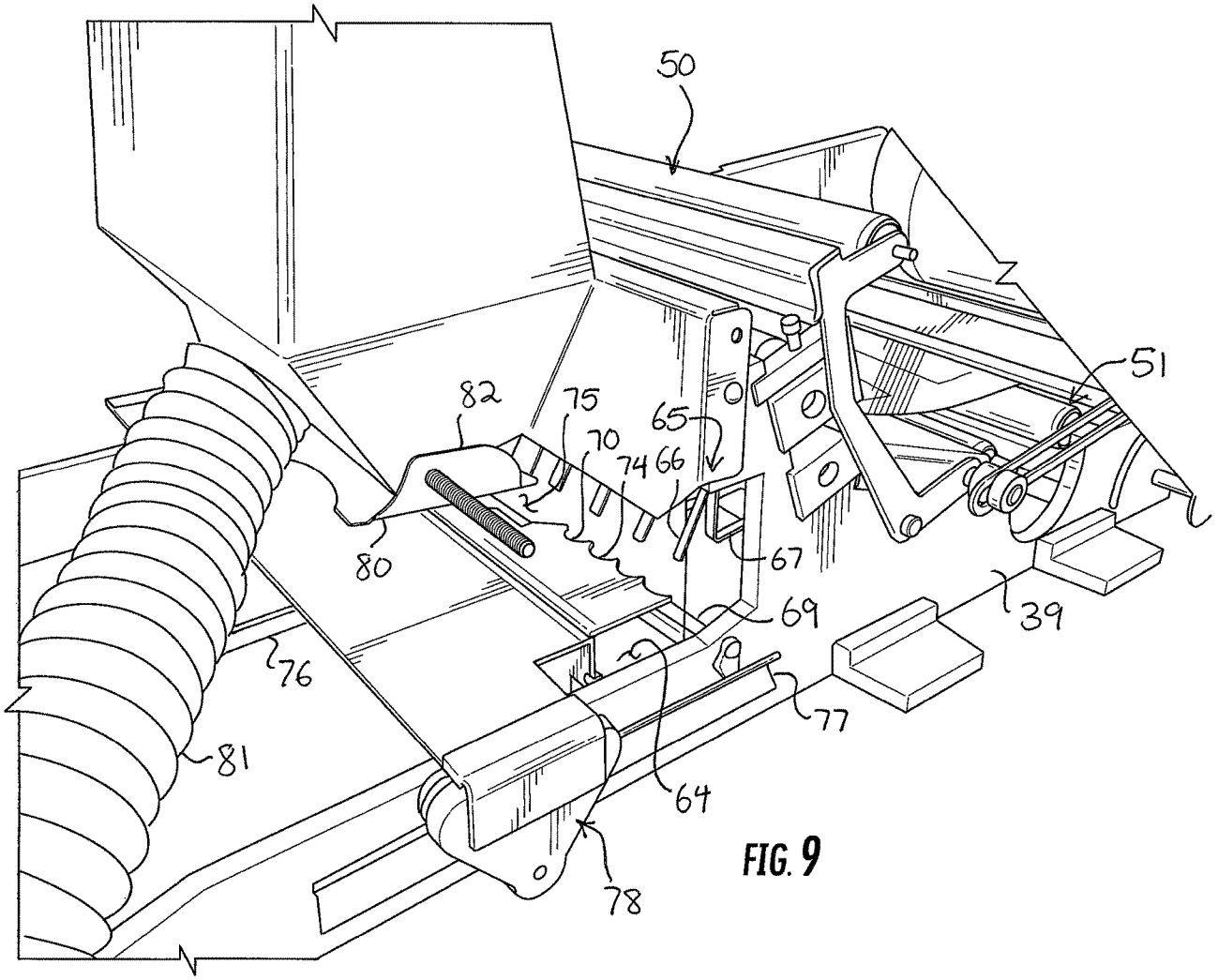

The ice bagger 31 includes several sensors for determining the status and location of the bag 32 within the ice bagger 31. With reference to FIG. 7, a reader sensor 83 is located just downstream from the lower roller assembly 51, above the sheet 36 of bags 32. The reader sensor 83 includes a transmitter above the sheet 36 and a reflector below the sheet 36, and detects whether an opaque band 41 or a transparent plastic portion of the bag 32 is passing just below the reader sensor 83. The transmitter of the reader sensor 83 is positioned to project a beam toward the reflector of the reader sensor 83. The reflector reflects the beam and the transmitter receives and detects the beam when the transparent plastic portion of the bag 32 passes through the beam. The reflector of the reader sensor 83 does not reflect the beam, and the transmitter does not receive and detect a reflected beam, when the beam is blocked by an opaque portion of the bag 32, such as one of the bands 41, passing by.

Still referring to FIG. 12, another sensor is carried near the top of the flap 73 and is identified here as a bag open sensor 84. The bag open sensor 84 is a reflective sensor that detects when the bag 32 is blown open against the flap 73 and is ready to receive ice. The bag open sensor 84 is directed parallel to the flap 73, and transmitter and reflector units of the bag open sensor 84 are disposed proximate to the side edges of the flap 73, opposite to each other, and on both sides 32*c* and 32*d* of the bag 32 when the bag 32 is blown open against the flap 73.

A third sensor is mounted near the bottom of the flaps 72 and 73 and is identified here as a bag full sensor 85. The bag full sensor 85 is a line-of-sight sensor and includes a transmitter on one flap 72 and a receiver on the other flap 73. Holes through each of the flaps 72 and 73 allow the transmitter to transmit a beam across the throat 64 to the receiver. When the bag 32 has been filled with ice to a predetermined level, the ice blocks the beam from the transmitter to the receiver and the sensor 81 registers the bag as full.

Each of these sensors 83, 84, and 85 is coupled to the computer 24 which processes the information detected by the sensors. As will be explained, the computer 24 instructs the ice vending machine 20 to take action, or refrain from action, in response to receipt and processing of information from each of the sensors 83, 84, and 85.

Referring still to FIG. 12, the basket 71 is separate from the bag feed assembly 33 and is below the enclosure 22. The basket 71 is carried on a trolley 90 which includes opposed front and rear rails 91. The rails 91 ride along a toothed rack 92 depending from the top of the merchandiser 21. The rails 91 and rack 92 extend across the width of the merchandiser 21, and the trolley 90 includes a driving motor coupled to drive a pinion gear 93 that is enmeshed with the rack 92 to move the trolley 90 in transverse movement back and forth across the width of the merchandiser 21 along the rails 91.

The basket 71 has an elongate body with opposed sides, opposed endwalls, a bottom 94, and an open top 95. The basket 71 depends from the trolley 90 and is mounted for rotation to the trolley 90 along the double-arrowed arcuate lines E shown in FIG. 12. The basket 71 pivots between a vertical position, a forwardly-tipped position, and a rearwardly-tipped position. A motor 96 is coupled to one endwall of the basket 71 to tip the basket 71 forwardly and rearwardly. In the vertical position, the bottom 94 of the basket 71 is directly below the top 95 of the basket 71. In the forwardly-tipped position, the basket 71 is rotated, the top 95 of the basket 71 is oriented toward a front of the interior 30 of the merchandiser 21, and the bottom 94 of the basket 71 is oriented toward a back of the interior 30. In the rearwardly-tipped position, the basket 71 is rotated, the top 95 of the basket 71 is oriented toward the back of the interior 30 of the merchandiser 21, and the bottom 94 of the basket 71 is oriented toward the front of the interior 30 of the interior 30 of the merchandiser 21. A sensor 97 mounted between the trolley 90 and the one of the endwalls proximate to the motor 96 detects and checks pivotal movement of the basket 71.

As will be explained in greater detail later, the merchandiser 21 stores sealed bags 32 filled with ice available for customers to select and purchase. The trolley 90 deposits bags 32 just after being filled with ice into the merchandiser 21, preferably in ordered stacks 98 in the front and rear of the merchandiser 21. The trolley 90 carries sensors for determining arrangement of the bags 32 in the merchandiser 21. Two ultrasonic transceivers or sensors 100 are mounted to the trolley 90 in front of and behind the basket 71. One ultrasonic sensor 100 is carried proximate to the front of the merchandiser 21, and the other ultrasonic sensor 100 is carried proximate to the rear of the merchandiser 21. The ultrasonic sensors 100 are oriented downwardly from the trolley 90 so as to produce downwardly-directed sound waves that echo against the bottom of the merchandiser 21, or against the bags 32 that have been previously stacked in the merchandiser 21, and reflect back to the respective ultrasonic sensor 100 for detection by the respective ultrasonic sensor 100, respectively. The ultrasonic sensors 100 are each connected by data cable to the computer 24, which measures the length of time between transmission and reception of the sound wave. By measuring the time between the production of the sound wave and the receipt of the reflected sound wave, the computer can determine the distance between the ultrasonic sensors 100 and the object below the ultrasonic sensors 100, whether that be the bottom of the merchandiser 21 or the top of a stack 98 of bags 32.

After a bag 32 is fed to the basket 71, the bag must be filled with ice; this ice is produced in the ice vending machine 20 by the ice makers 23. Referring back to FIG. 1, each ice maker 23 is exemplary of a common and well-known ice maker that produces cubed ice, such as the Hoshizaki KM-1300 or the like. In the embodiment shown in FIG. 1, two ice makers 23 are mounted atop the enclosure 22, but the ice vending machine 20 may include only a single ice maker 23 if the ice vending machine 20 requires less overall quantity or less production frequency. The enclosure 22 includes two hoppers, each positioned under one of the ice makers 23. The chute 80 is located between the hoppers and is in communication with each of the hoppers and the throat 64 to route ice from the hoppers into the throat 64 and prevent ice from spilling into other portions of the ice vending machine 20. The pivoting plate 82 on the chute 80 further prevents ice spillage. Augers within the hoppers break up and move ice produced by the ice maker 23 into the chute 80 when the ice vending machine 20 is operating.

The computer 24 controls operation of the ice vending machine 20. The computer 24 is coupled in communication with the doors 26 and 27, the bag feed assembly 33, the drive roller 63, the motor 96 controlling pivotal movement of the basket 71, the motor driving the pinion gear 93 on the trolley 90, the ice makers 23, the augers within the hoppers, the fan assembly, the trolley 90, and all of the sensors throughout the ice vending machine 20. Wires electronically couple the computer 24 to the components of the ice vending machine 20. One having reasonable skill in the art will readily appreciate that the computer 24 may also be wirelessly coupled in communication with the various components of the ice vending machine 20.

With reference primarily to FIG. 12, and accompanying reference to other drawings as identified below, to operate the ice vending machine 20, a person, such as a store attendant, must load a spool 42 holding a sheet 36 of bags 32 and route the sheet 36 through the bag feed assembly 33 so that bags 32 will be available in the ice bagger 31. The store attendant stands in front of the ice vending machine 20, lifts the front cover 25 on the enclosure 22, and moves the swingarms 43 and 44 down from the raised position to the lowered position thereof. The store attendant removes an empty spool 42 (the bags 32 having all been used by the ice vending machine 20) from the cradles 43*c* and 44*c* and places a new spool 42 holding a fresh supply of a sheet 36 of bags 32 into the cradles 43*c* and 44*c*. Each spool 42 has between about five hundred and one thousand bags, and, of course, other quantities can be used as well, according to the needs of the ice vending machine 20.

While the spool 42 is in the extended position, a free or lead end of the sheet 36 is pulled downward from the spool 42, thus unwinding the sheet 36 from the spool 42. The store attendant assures the upper roller assembly 50 is in the raised position (shown in FIGS. 3B and 5B) and then threads the lead end of the sheet 36 of bags 32 under the guide roller 55, directly over both of the rollers 53 and 54, and between the rollers 63*a* and 63*b*, which grip the lead end of the sheet 36. The store attendant next lowers the upper roller assembly 50 to the lowered position. In doing so, the roller 60 depresses the sheet 36 being held over the lower roller assembly 51 between and below the rollers 53 and 54, thereby weaving the sheet 36 of bags 32 between the upper and lower roller assemblies 50 and 51. Slack in the sheet of bags 32 is played out from the spool 42 to accommodate this weaving.

Once the sheet 36 of bags 32 has been routed through the bag feed assembly 33, the computer 24 is initialized. The store attendant enters the number of bags 32 on the spool 42 and other information, such as bag capacity. Once the computer 24 is set up, the front cover 25 of the enclosure 22 is closed and the ice vending machine 20 is ready for automatic operation.

Operation of the ice vending machine 20 then proceeds. The computer 24 instructs the trolley 90 to begin searching for a low point among the stacks 98 of bags 32 of ice in the merchandiser 21. The bags 32 of ice are arranged in two rows of stacks 98: a front row, arranged along the front of the merchandiser 21 proximate to the doors 26 and 27, and a rear row, arranged along the back of the merchandiser 21. During operation, each bag 32 of ice is placed in a discrete location in one of either of the rows; bags 32 are stacked upon each other and do not overlap, thereby forming the vertical stacks 98 of bags 32 in each row, with each stack 98 having a particular stack height. FIG. 12 shows that one of the stacks 98 along the rear row in the merchandiser 21 has a representative stack height H. The stack height H of each stack 98 within the merchandiser 21 may be, and will likely be, different from other stack heights H. The ultrasonic sensors 100 on the trolley 90 are located on the trolley 90 so as to be directly above centers of each of the stacks 98 in the front and rear rows; one ultrasonic sensor 100 is directly above the front row, and the other ultrasonic sensor 100 is directly above the rear row.

To begin searching, the trolley 90 moves to one side of the merchandiser 21, and the ultrasonic sensors 100 each issue an ultrasonic pulse or wave downward toward the first stack 98 of bags 32 in the front and rear row, respectively, on the left side of the merchandiser 21 to determine whether each stack height H is low. The ultrasonic pulses travel down from the ultrasonic sensors 100, bounce off the stacks 98, and return to the ultrasonic sensors 100. The time between the issuance of the ultrasonic pulse and the receipt of the reflected pulse is measured by the computer 24, and the stack height H of each stack 98 is calculated. If the stack height H is above a selected or predetermined stack height H, the computer 24 determines that the location is full and instructs the trolley 90 to move to the next location, preferably one stack 98 to the right. It should be noted that although the designator "full" is used to describe a stack height H, the corresponding stack 98 does not necessarily fill the height of the interior 30 of the merchandiser 21, it merely indicates that the stack height H is above whatever height has been selected by the operator of the ice vending machine 20 or the store attendant. If, on the other hand, the stack height H is below the predetermined stack height, the computer 24 stores the stack height H for that particular stack 98 in memory, and begins an ice production process. As the ice production process runs, the computer 24 instructs the trolley 90 to move to the next stack 98 and measure the stack height H. Each stack height H is measured and stored in memory.

To produce ice, the computer 24 issues an instruction to one or both of the ice makers 23 to begin producing ice. The ice makers 23 produce ice according to conventional and well-known methods that one having ordinary skill in the art will readily appreciate and thus need not be described further here. The ice vending machine 20 enters a wait period during which the ice makers 23 are allowed to produce ice. The wait period continues until ice is produced by the ice makers 23 and deposited into the hoppers. The time required to fill an empty hopper with ice is between twenty-five and forty-five minutes. Each of the hoppers provides approximately forty pounds of ice, which is enough ice to fill approximately three to four ten-pound bags 32 of ice.

Once the ice is produced and available in the hoppers, a bag 32 is fed through the bag feed assembly 33, through the throat 64, and is provided to and seated in the basket 71. The bag 32 is fed through the bag feed assembly 33 in response to the drive rollers 63*a* and 63*b* rotating in opposite directions, so as to move the sheet 36 downstream. Tension is maintained on the sheet 36 of bags 32 by the enmeshed rollers of the tensioning assembly 45, thereby avoiding looseness or buckling of the sheet 36, which ensures proper reading and operation.

As the bag 32 is fed through the bag feed assembly 33, the read sensor 83 views and reads the passing bag 32. The bands 41 on the bag 32 are arranged across the front face 34 of the bag 32 and are spaced apart along the height of the bag 32 between the top 32*a* and the bottom 32*b* so as to be read during translational downstream movement past the read sensor 83. The transmitter of the read sensor 83 directs a beam to the reflector for reflection back to the transmitter. As the bottom 32*b* of the bag 32 passes by the read sensor 83, the beam is reflected through a transparent plastic portion, and the read sensor 83 detects only the transparent portion. The beam is then blocked as the opaque second minor band 41*c* proximate to the bottom 32*b* of the bag 32 passes by the read sensor 83. The beam is then reflected through a second transparent plastic portion between the second minor band 41*c* and the major band 41*b*, and the beam is then blocked by the opaque major band 41*b*. The beam is again reflect through a transparent plastic portion of the bag 32 between the major band 41*b* and the first minor band 41*a*, and the beam is then blocked by the first minor band 41*a*. The computer 24 is in communication with the read sensor and the motor driving the drive roller 63 which feed the sheet of bags 32. Because the computer 24 knows the speed of the drive roller 63, the computer can determine the speed of the bag 32 through the bag feed assembly 33. The computer 24 also measures the time during which the beam is not detected by the read sensor 83, or in other words, the time during which the beam is blocked by one of the bands 41. Given the speed of the bag 32 and the time of blocking, the computer 24 calculates the height of each band 41. Because each band 41 on the bag 32 has a different height, and because every bag 32 has the same pattern 40, the computer can determine that one bag 32 has passed by the read sensor 83 when it detects that the particular pattern 40 of the second minor band 41*c*, the major band 41*b*, and the first minor band 41*a* have passed in that order.

The computer 24, recognizing that one bag 32 has moved downstream past the read sensor 83, increments a bag count, because passage of one pattern 40 of bands 41 indicates that one bag 32 has passed the read sensor 83. The bag count is useful in storing, analyzing, and displaying performance statistics. For instance, the store attendant, during refilling, inputs to the computer 24 the quantity of bags 32 on the new spool 42. When the bag count is incremented, one bag 32 has been used from the spool 42, and when the bag count reaches the quantity of bags 32 initially on the spool 42, no bags remain, and the computer 24 can instruct the ice vending machine 20 to take various actions, such as ceasing operation, issuing an alert to the store attendant, or producing a report. Likewise, when the bag count approaches the quantity of bags 32 initially on the spool 42, the computer can alert the store attendant that the spool 42 will soon need to be replaced.

The sheet 36 of bags 32 moves through the drive rollers 63*a* and 63*b* and contacts the guide 65. The shape of the fingers 66 and 67 of the guide 65 causes the sheet 36 to turn downward. Only a single bag 32 hangs downstream from the rollers 63 into the throat 64. The drive rollers 63*a* and 63*b* are advanced until the top 32*a* of the bag 32 is proximate to the bottom of the fingers 66 and 67, and approximately level with the cutting element 70. In this way, the bag 32 is seated in the basket 71.

When the bag 32 is seated in the basket 71, the bag open sensor 84 is energized. If the computer 24 determines from the bag open sensor 84 that the bag 32 is not open, the blower in the fan assembly is activated to blow the top 32*a* of the bag 32 open. Because the cutting element 70 is in the retracted position thereof, the chute 80 is not closed, and air blown from the blower blows open the bag 32. Once the top 32*a* of the bag 32 is open, the bag 32 is ready to accept ice. The bag open sensor 84 detects that the bag 32 is open, and the computer 24 instructs the augers to turn to begin applying ice to the open bag 32. The augers move the ice from the hoppers into the chute 80, and the ice moves down the chute 80 and into the bag 32, filling the bag 32. The chute 80 is cradled in the recess 75, which is open since the cutting element 70 is in the retracted position thereof. The bag full sensor 85 is located at the flaps 72 and 73 proximate to the top 32*a* of the bag 32, and filling continues as long as the bag full sensor 85 detects that the bag 32 is not full. It should be noted that "full" is a relative term indicating that the bag 32 has been filled with a quantity of ice for which the bag 32 is desired or rated, and which allows the bag 32 to still be sealed proximate to the top 32*a*.

Upon the bag full sensor 85 detecting that the bag 32 is full, the computer 24 instructs the augers to stop moving ice into the chute 80, and the bag 32 is cut and sealed. To cut the bag 32, the piston 76 is actuated and extended, and the cutting element 70 is advanced. The cutting element 70 advances forwardly just below the fingers 77, causing the bag 32 to yield and tear. Advancement of the cutting element 70 pushes the top 32*a* of the bag 32 into a heating element 69 near the rear of the frame 37, in the throat 64 below the fingers 67 and the tensioning assembly 45; the cutting element 70 is thus mounted distal to the heating element 69 for reciprocal movement with respect to the heating element 69. A thermal pad mounted below the cutting element 70 presses the top 32*a* of the bag 32 into the heating element 69, melting the plastic of the bag 32 to seal the bag 32 just below the top 32*a* where the bag 32 is cut. In the advanced position of the cutting element 70, it is against the heating element 69; in the retracted position of the cutting element 70, it is away from the heating element 69. The heating element 69 includes an identification code or brand, so as to brand into the seal a unique combination of letters and numbers for identification purposes. For example, the heating element 69 may carry the characters "1A2B" such that all bags sealed by the ice vending machine 20 are branded with "1A2B" to indicate where the bag was made, in what production run or around what date and time.

Once the bag 32 is sealed, the filled bag 32 of ice is supported by and held within the basket 71 in the trolley 90. The trolley 90 then moves to the stack 98 at which the bag 32 will be placed. Stored in the memory of the computer 24 is the last known low stack height H. This may be the lowest stack height H among all the stacks 98 in the merchandiser 21. The trolley 90 moves to a position over that stack 98 and deposits the bag 32 of ice onto that stack 98. If the stack 98 having the low stack height H is in the front row in the merchandiser 21, the computer 24 instructs the motor 96 to rotate in a clockwise direction, imparting movement to the basket 71 to tip forwardly. Once the basket 71 reaches a pre-determined tipping point, as detected by the sensor 97, the bag 32 is deposited from the basket 71, falling out of the open top 95 of the basket and onto the stack 98 having the low stack height H. Alternatively, if the last known low location is in the front row in the merchandiser 21, the computer 24 instructs the motor 96 to rotate in a counter-clockwise direction. Once the basket reaches a pre-determined tipping point, as detected by the sensor 97, the bag 32 is deposited out of the basket 71, falling out of the open top 95 of the basket 71 and onto the stack 98 having the low stack height H. Once the bag 32 is deposited, the ice vending machine 20 determines the next low stack height H. This process of feeding, opening, filling, cutting, sealing, and depositing a bag 32 requires approximately only ninety seconds for a ten-pound bag 32 of ice, which represents an improved cycle time over previous inventions.

The ice vending machine 20 includes various processes which respond to customer interaction and provide customer safeguards. The process described above is initiated after a start-up of the ice vending machine 20, such as would occur after loading a new spool 42, after loading a replacement spool 42, after the ice vending machine 20 has been inactive for some time, or in other instances. The process is also initiated by the opening of either or both of the doors 26 and 27. The sensors in the doors 26 and 27 detect when the doors are open. The opening of either door 26 or 27 generally indicates that a customer has chosen and removed at least one bag 32 of ice from the merchandiser 21. The customer may have taken a single bag 32, several bags 32 from a single stack 98, or several bags 32 from several stacks 98, thereby altering the stack height H of one or several stacks 98 of bags 32 of ice. After the one of the doors 26 and 27 closes, the ice vending machine 20 begins searching for a new low stack height H among the stacks 98 of bags 32 of ice. For safety, subsequent opening of either of the doors 26 and 27 interrupts the process if a sensor in either of the doors 26 and 27 indicates that either of the doors 26 or 27 is opened, so that if a customer opens either of the doors 26 or 27 while the trolley 90 is moving, the computer 24 will pause the process, and the trolley 90 will stop moving so as to reduce the likelihood of injury to the customer and damage to the ice vending machine 20. When the sensors in the doors 26 and 27 indicate that the doors 26 and 27 are closed, the computer 24 will instruct the ice vending machine 20 to resume operation from the pause, and the trolley 90 will continue to move.

The ice vending machine 20 is coupled in communication to a server via a network, to which user devices are adapted to connect in order to view information about the ice vending machine 20. The network includes the Internet, wired and wireless networks, local area networks, and other like networks. The user devices include computers, phones, tablet devices, personal communication devices, and other communication and information devices. The computer 24 records information about the ice vending machine 20, such as daily production totals, login information (store attendant identification number, store attendant time in, store attendant time out), bags 32 consumed, bags 32 remaining on the spool 42, error history, quantity of ice in the merchandiser 21, and other similar information. The computer 24 also records information about the ice vending machine 20 such as service maintenance history and upcoming requirements, sales information by day, month, and year, sales projections based on previous production and sales history, automatic invoicing, low bag notifications, low ice warnings, and other similar information. The computer 24 stores the information locally on internal memory and transmits the information to the server via the network. The number of bags 32 consumed corresponds to the bag count maintained and altered by the computer 24 in response to the movement of the bands 41 on the bags 32 across the reader sensor 83. The number of bags 32 remaining on the spool 42 corresponds to the number of bags initially on the spool 42 less the number of bags 32 consumed. In addition to the information being available for fetching on a user device via the network, the ice vending machine 20 is adapted to push notifications of information to user devices through server via the network, such as by email, text, a telephone call, or the like. The ice vending machine 20 can push warnings, alerts, maintenance reminders, and like information.

When the ice vending machine 20 is due for maintenance or needs repair, the construction of the ice bagger makes such maintenance and repair much easier compared to conventional ice merchandisers. Namely, the unique construction and arrangement of the two-piece frame 37 enables a technician to quickly and easily remove parts from the ice bagger 31. The frame 37 is constructed of the frame elements 38 and 39. Both of the frame elements 38 and 39 are unitary structures, meaning they each are composed from a single, monolithic, integral piece. Nevertheless, the frame elements 38 and 39 are constructed from a material or combination of materials having rigid, strong, lightweight properties, such as a metal like aluminum. The frame elements 38 and 39 extend entirely along the opposed sides of the ice bagger 31 from the front to the back thereof. The frame elements 37 and 38 are identical in every respect but location, and as such, the description herein will refer to only one them, with the understanding that the description applies equally to the other.

Figure 3A:
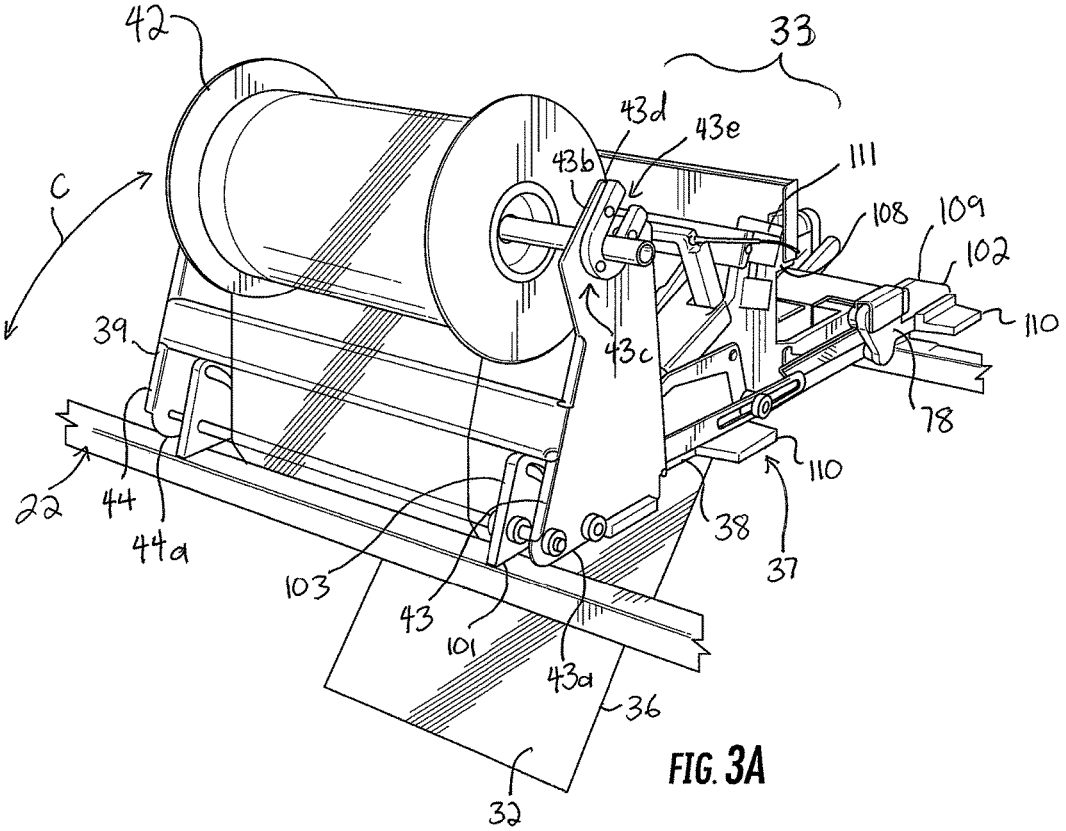
FIGS. 3A and 3B are front perspective views of a spool and a tensioning assembly of the ice bagger of FIG. 1, with the spool in retracted and extended states, respectively.
Figure 3B:
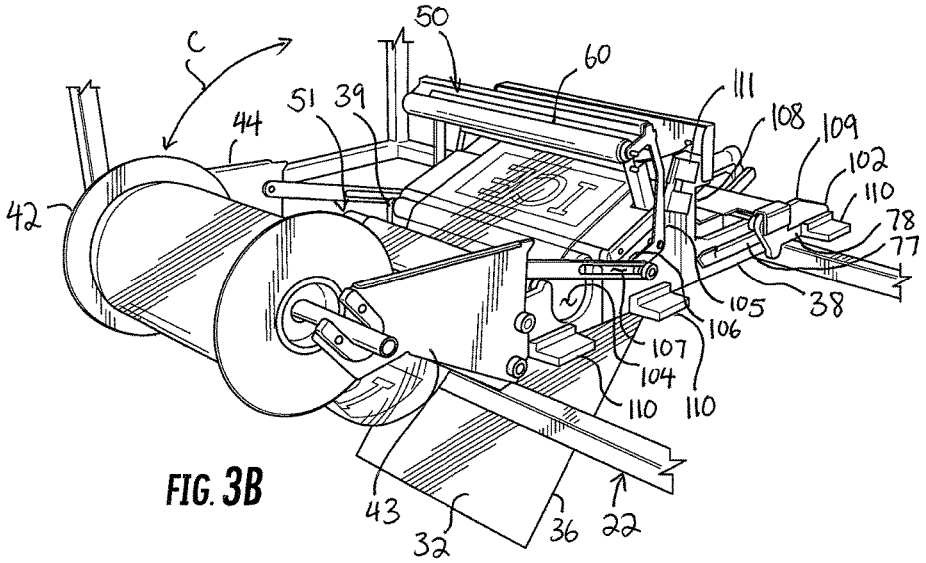
Figure 4:
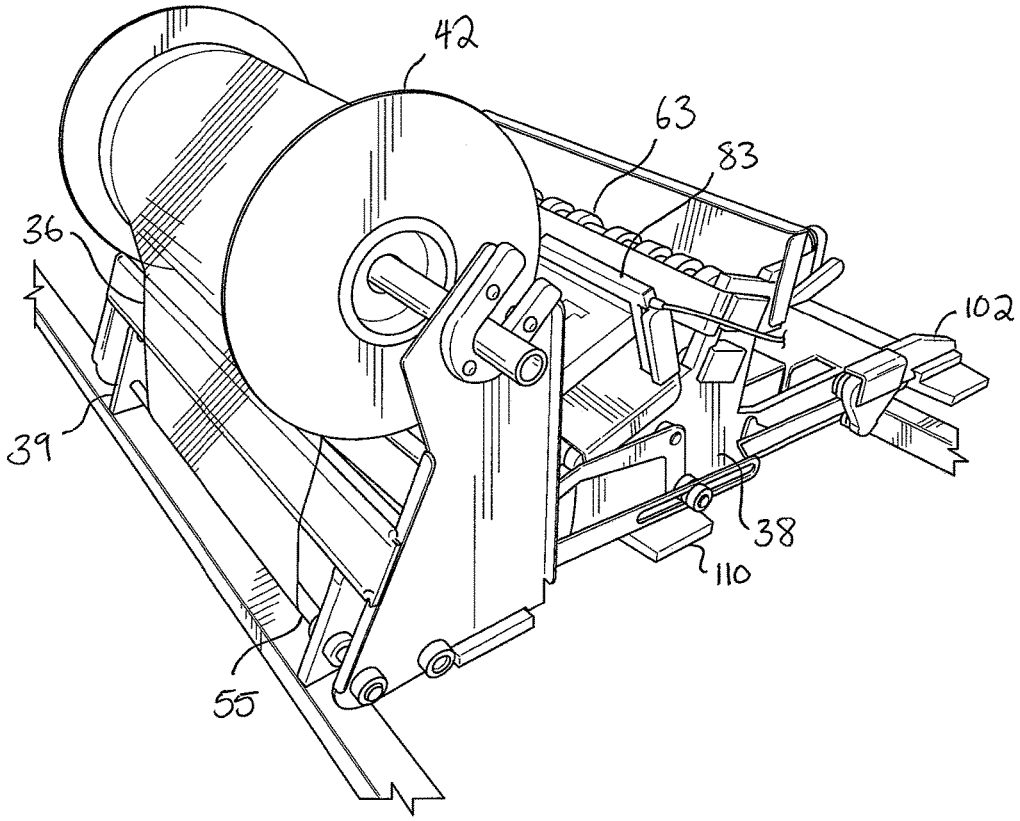
FIG. 4 is a side perspective view of the spool and the tensioning assembly of the ice bagger of FIG. 1.
Figure 5A:
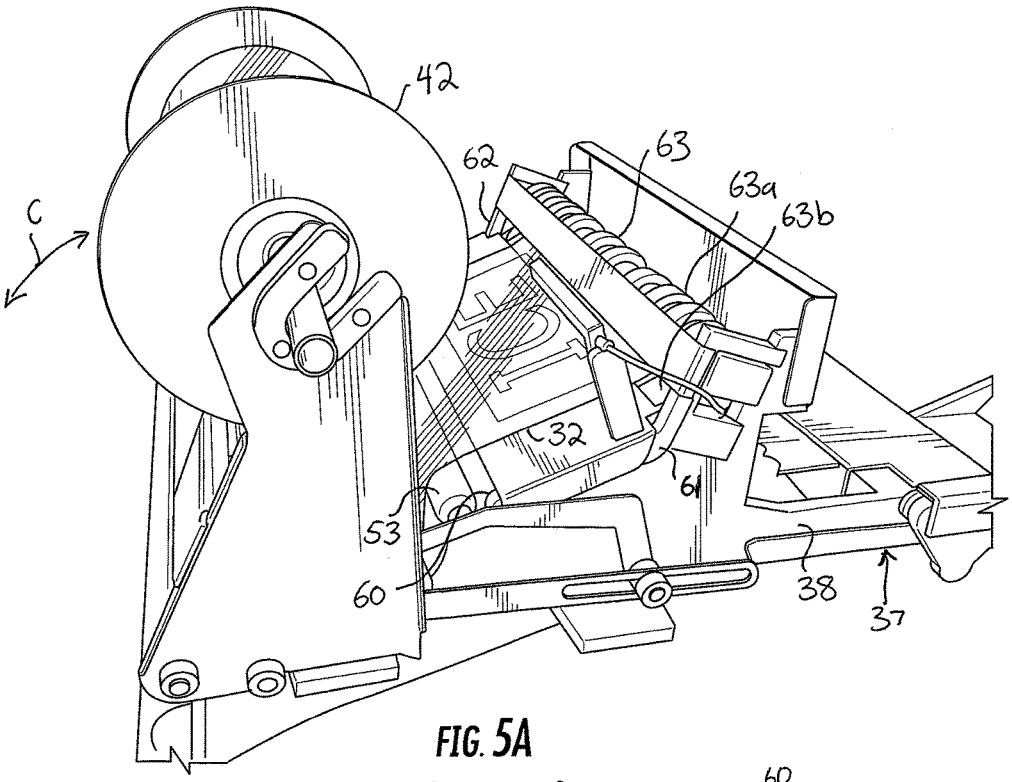
FIGS. 5A and 5B are side perspective views of the spool and the tensioning assembly of the ice bagger of FIG. 1, with the spool in the retracted and extended states, respectively.
Figure 5B:
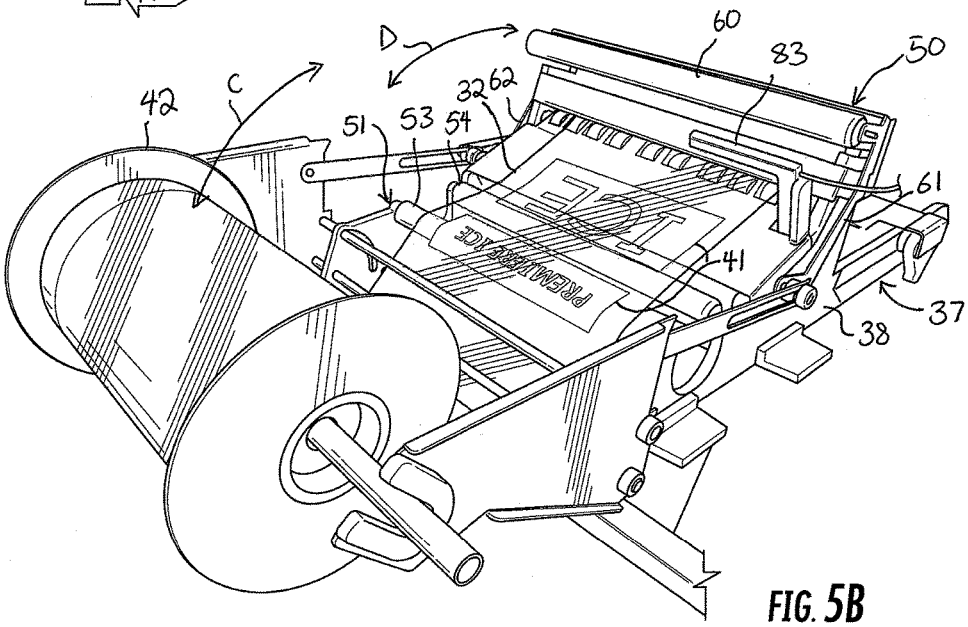
Figure 6A:
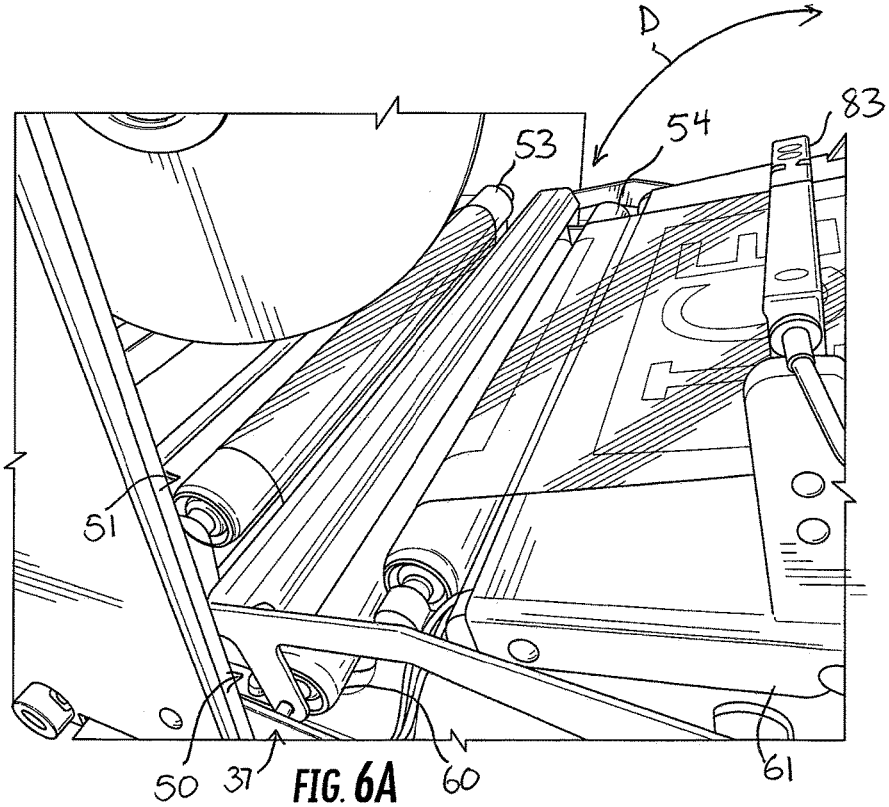
FIGS. 6A and 6B are enlarged, side perspective views showing the tensioning assembly in detail.
Figure 6B:
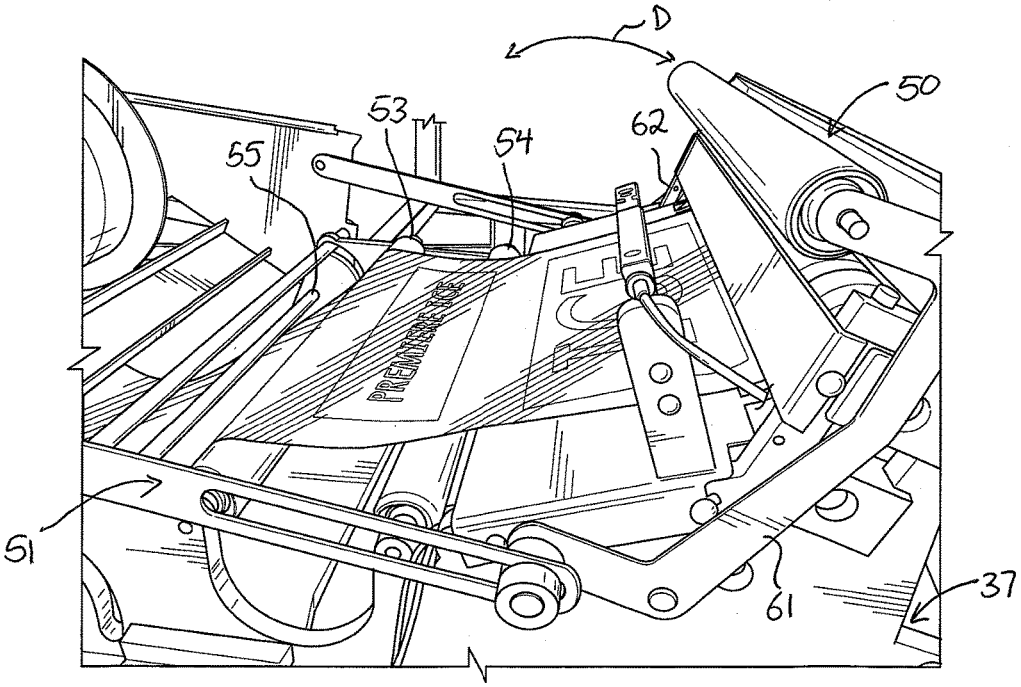

As shown in FIGS. 3A and 3B, the frame element 38 includes a front 101 and a rear 102, which correspond to the front and rear of the frame 37. Proximate the front 101 is a triangular mount 103. The swingarm 43 is pivoted to the triangular mount 103. The triangular mount 103 elevates the swingarm 43 above the enclosure 22, so that the spool 42 can pivot without interruption between the retracted and extended positions.

Distal to the triangular mount 103 is a deep semi-circular notch 104 extending downward into the frame element 38. The notch 104 is a catch and receiving space for the roller 60 when the upper roller assembly 50 is in the lowered position thereof. The upper roller assembly 50 includes arms 105 which are pivoted to the frame 37. Each arm 105 is sickle-shaped, with a pivot to the frame 37 formed at an inflection of the arm 105, the roller 60 at one end of the arm 105, and an outwardly-extending pin at the other end of the arm 105. Another arm, or linkage 106, is pivoted to the arm 105, but extends forwardly to the swingarm 43. The linkage 106 is an elongate member including a longitudinal slot 107. The slot 107 is fit over the outwardly-extending pin of the arm 105, such that the arm 105 and the linkage 106 are operatively coupled to each other to impart movement to each other. When the spool 42 is in the raised position, the linkage 106 moves rearward, and the pin slides forward in the slot 107, causing the arm 105 to move downward, thereby urging the upper roller assembly 50 into the lowered position, as shown in FIG. 3A. Conversely, when the spool 42 is in the lowered position, the linkage 106 moves forward, and the pin slides rearward in the slot 107, causing the arm 105 to move upward, thereby urging the upper roller assembly 50 into the raised position, as shown in FIG. 3B. In this way, the technician can simultaneously move the spool 42 into the lowered position so that it can be checked or replaced, and can move the upper roller assembly 50 up so that the tension on the sheet 36 is released and the tensioning assembly 45 is disengaged.

Behind the notch 104 is a riser 108. The riser 108 projects vertically upward on the frame element 38 and holds fixed the drive rollers 63 in slots at an elevated position above the upper and lower roller assemblies 50 and 51. The vertical projection also creates the throat 64 behind and under the drive rollers 63. At the top of the riser 108, the drive rollers 63 sit in cradles, which are notches in the riser 108. The drive rollers 63 are captured and restrained in the cradles by caps 111 engaged over the drive rollers 63 and the riser 108. If the drive rollers 63 need to be repaired or replaced, the cap 111 is disengaged and removed, so that the drive rollers 63 can be removed from the top of the frame 37, without impacting or interfering with other parts of the ice bagger 31.

Distal to the riser 108 is a horizontal extension 109, which extends fully to the rear 102 of the frame element 38. The horizontal extension 109 is a long, slender lateral projection of the frame element 38 to which the rail 91 is coupled, thereby providing the slide 78 with a long stroke of reciprocation. The frame 37 is open at the rear 102, such that if the cutting element 70 needs to be repaired or replaced, the slides 78 can simply be pulled off the rails 91 through the rear 102, without impacting or interfering with other parts of the ice bagger 31. This makes replacement of the cutting element 70 or the piston 76 quick and easy.

The frame element 38 is coupled to the enclosure 22 with three brackets 110 spaced along the length of the frame element 38. This is the only engagement with the enclosure 22, such that if the entire ice bagger 31 needed to be replaced, the brackets 110 could simply be decoupled from the enclosure 22 and a new ice bagger 31 dropped in place.

A preferred embodiment is fully and clearly described above so as to enable one having skill in the art to understand, make, and use the same. Those skilled in the art will recognize that modifications may be made to the description above without departing from the spirit of the invention. To the extent that such modifications do not depart from the spirit of the invention, they are intended to be included within the scope thereof.

The invention claimed is:

1. A bagging machine for use on an ice vending machine, the ice vending machine including an ice merchandiser and an ice maker producing ice and conveying it out a chute, the bagging machine comprising:

a frame comprised of opposed, unitary, first and second frame elements;

a spool of bags pivoted to a front of the frame on a swingarm;

a heating element carried near a rear of the frame;

a cutting element, distal to the heating element, mounted to the frame for reciprocal movement toward and away from the heating element; and a tensioning assembly carried on the frame to provide tension to bags unrolled from the spool.

2. The bagging machine of claim 1, wherein the tensioning assembly is oriented obliquely from the front of the frame toward the rear of the frame, defining a throat under the tensioning assembly in which the heating element is disposed.

3. The bagging machine of claim 1, wherein the tensioning assembly includes a set of lower rollers, a set of upper rollers moveable between a lowered position in meshing engagement with the set of lower rollers, and a raised position away from the lower rollers, and a set of fixed rollers above and behind the sets of lower and upper rollers.

4. The bagging machine of claim 3, wherein the set of fixed rollers is carried in the opposed first and second frame elements and is restrained by caps applied over the first and second frame elements.

5. The bagging machine of claim 3, wherein the swingarm is pivoted to the set of upper rollers, such that pivoting the spool of bags from a retracted position to an extended position imparts movement of the set of upper rollers from the lowered position to the raised position.

6. The bagging machine of claim 1, wherein the cutting element is mounted on a first slide on the first frame element and a second slide on the second frame element, and is driven by drive means disposed centrally to the first and second frame elements.

7. The bagging machine of claim 1, further comprising a guide below the tensioning assembly, the guide comprising a plurality of laterally-spaced apart, downwardly-turned fingers.

8. The bagging machine of claim 7, wherein:

the cutting element moves between an advanced position and a retracted position;

in the advanced position, the cutting element is against the heating element; and in the retracted position, the cutting element is behind the guide.

9. The bagging machine of claim 1, wherein the cutting element includes a cutting edge formed with a recess, the recess configured to be disposed below the chute of the ice maker when the bagging machine is applied to the ice vending machine.

10. An ice vending machine for dispensing a bag, filing the bag with ice, and vending the bag to consumers, the ice vending machine comprising:

a merchandiser having a door providing access into an interior of the merchandiser;

an ice maker with a chute; and a bagging machine mounted to the merchandiser in communication with the ice maker, the bagging machine comprising:

a frame comprised of opposed, unitary, first and second frame elements;

a spool of bags pivoted to a front of the frame on a swingarm;

a heating element carried near a rear of the frame;

a cutting element, distal to the heating element, mounted to the frame for reciprocal movement toward and away from the heating element; and a tensioning assembly carried on the frame to provide tension to bags unrolled from the spool.

11. The bagging machine of claim 10, wherein the tensioning assembly is oriented obliquely from the front of the frame toward the rear of the frame, defining a throat under the tensioning assembly in which the heating element is disposed.

12. The bagging machine of claim 10, wherein the tensioning assembly includes a set of lower rollers and a set of upper rollers moveable between a lowered position in meshing engagement with the set of lower rollers and a raised position away from the lower rollers.

13. The bagging machine of claim 12, wherein the tensioning assembly further includes a set of fixed rollers above and behind the sets of lower and upper rollers.

14. The bagging machine of claim 12, wherein the set of fixed rollers is carried in the opposed first and second frame elements and is restrained by caps applied over the first and second frame elements.

15. The bagging machine of claim 12, wherein the swingarm is pivoted to the set of upper rollers, such that pivoting the spool of bags from a retracted position to an extended position imparts movement of the set of upper rollers from the lowered position to the raised position.

16. The bagging machine of claim 10, wherein the cutting element is mounted on a first slide on the first frame element and a second slide on the second frame element, and is driven by a push disposed centrally to the first and second frame elements.

17. The bagging machine of claim 10, further comprising a guide below the tensioning assembly, the guide comprising a plurality of laterally-spaced apart, downwardly-turned fingers.

18. The bagging machine of claim 17, wherein:

the cutting element moves between an advanced position and a retracted position;

in the advanced position, the cutting element is against the heating element; and in the retracted position, the cutting element is behind the guide.

19. The bagging machine of claim 10, wherein the cutting element includes a cutting edge formed with a recess, the recess disposed below the chute of the ice maker when the bagging machine is applied to the ice vending machine.

20. The bagging machine of claim 19, further comprising:

a plate pivoted to the chute;

the cutting element moves between an advanced position and a retracted position;

movement of the cutting element from the retracted position to the advanced position pivots the plate to close the chute; and movement of the cutting element from the advanced position to the retracted position pivots the plate to open the chute.

* * * * *